United States Patent [19]

Lang et al.

[11] Patent Number: 4,578,933

[45] Date of Patent: Apr. 1, 1986

[54] APPARATUS FOR STRAPPING A CUBOIDAL PACKAGE

[76] Inventors: Georg Lang, Marktheidenfelder Strasse 2,, Triefenstein; Berthold Bührle, Ringstrasse 25, Blaubeuren-Beiningen, both of Fed. Rep. of Germany

[21] Appl. No.: 576,563

[22] Filed: Feb. 3, 1984

[30] Foreign Application Priority Data

Feb. 5, 1983 [DE] Fed. Rep. of Germany ..... 3303956

[51] Int. Cl.[4] ..... B65B 27/08

[52] U.S. Cl. ..... 53/589; 53/590; 100/26

[58] Field of Search ..... 100/26; 53/589, 590, 53/399

[56] References Cited

U.S. PATENT DOCUMENTS

| | | | |
|---|---|---|---|
| 3,179,453 | 4/1965 | Walters | 289/18 |
| 3,271,925 | 9/1966 | Aubery | 53/589 X |
| 3,566,780 | 3/1971 | Chisek | 100/26 X |
| 3,783,773 | 1/1974 | Willard et al. | 100/26 X |
| 3,921,510 | 11/1975 | Glasson | 100/26 X |
| 4,020,755 | 5/1977 | Böhlmark | 100/26 X |
| 4,312,266 | 1/1982 | Pasic | 100/26 X |

FOREIGN PATENT DOCUMENTS

| | | |
|---|---|---|
| 0063675 | 2/1982 | European Pat. Off. . |
| 1880680 | 4/1959 | Fed. Rep. of Germany . |
| 1171811 | 6/1964 | Fed. Rep. of Germany . |
| 2155367 | 11/1971 | Fed. Rep. of Germany . |
| 2245505 | 3/1974 | Fed. Rep. of Germany . |
| 2403261 | 7/1975 | Fed. Rep. of Germany . |
| 2419079 | 11/1975 | Fed. Rep. of Germany . |
| 7924590 | 2/1980 | Fed. Rep. of Germany . |
| 3018402 | 11/1981 | Fed. Rep. of Germany . |
| 3140291 | 4/1983 | Fed. Rep. of Germany . |
| 1498021 | 10/1966 | France . |

OTHER PUBLICATIONS

"New Automatic Bundling Line", Packaging Review, Oct. 1959, pp. 79 and 81.

*Primary Examiner*—James E. Coan
*Attorney, Agent, or Firm*—Spencer & Frank

[57] ABSTRACT

An apparatus for strapping a cuboidal package by means of two intercrossing straps encircling the package in cross-sectional planes at right angles to one another. Two strap guide frames which, in respect to their frame plane, are disposed at right angles to a horizontal delivery plane extending in their clear frame opening, serve to transport the package, the strap being adapted to be guided, in each of the guide frames, around the clear frame opening. Associated with each strap guide frame is a device for inserting the strap into the strap guide frame and also for tensioning, locking, and cutting off the strap laid around the package.

5 Claims, 3 Drawing Figures

APPARATUS FOR STRAPPING A CUBOIDAL PACKAGE

BACKGROUND OF THE INVENTION

The invention relates to an apparatus for strapping a cuboidal package by means of two intercrossing straps encircling the package in cross-sectional planes at right angles to one another, comprising two strap guide frames which in respect of their frame plane are disposed at right angles to a horizontal delivery plane extending in their clear frame opening and serving to transport the package, the strap being adapted to be guided, in each of the said guide frames, around the clear frame opening, and further comprising, associated with each strap guide frame, a device for inserting the strap into the strap guide frame and also for tensioning, locking, and cutting off the strap laid around the package.

In one apparatus of this kind, which is known from German Preliminary Published Application No. 3,140,291, two strapping machines are disposed one behind the other in the direction of transport and with their frame planes parallel to one another and at right angles to the direction of transport. Between the two strapping machines is disposed a turntable lying at the same height as the transport plane. The cuboidal package which is to be strapped is first fed to the strapping machine disposed first in the transport direction, and is halted. The cuboid is aligned in such a manner that its central cross-sectional plane lies precisely in the frame plane of the strap guide frame. In this position the strap standing ready in the first strap guide frame is pulled out of the strap guide channel by means of an automatic sequence control and is thereby laid around the cuboid in this cross-sectional plane and also tensioned, locked and cut off. After this first work cycle the cuboid, now provided with an encircling strap, is moved forward on the turntable, on which in a second cycle the cuboid is turned 90°. The cuboid turned in this manner finally moves onto the transport plane of the second strapping machine, in which in a third cycle similar to the operation carried out in the first strapping machine it is provided with another encircling strap. The cuboid finally leaving the second strapping machine is in this way provided with two encircling straps extending crosswise.

In this known apparatus a multistage process is therefore necessary to carry out the strapping operation, and in this process the 90° rotation on the turntable, in particular, and also the repeated halting and re-acceleration of the package are extremely disadvantageous in respect of working speed. Moreover, the turntable with its associated drive constitutes not only a cost factor but also a possible source of failure. Finally, the turntable disposed between the two strapping machines also means that more space is required for the apparatus.

SUMMARY OF THE INVENTION

The problem underlying the invention is that of eliminating, in an apparatus for strapping a cuboidal package of the kind described above, a 90° rotation and repeated halting and acceleration of the package within the apparatus, thereby increasing working speed.

According to the invention this problem is solved in that the frame planes of the two strap guide frames intersect at right angles along a common vertical center line, and that a device is provided for adjusting the package to a position in which its edges are parallel to the strap guide frames.

For the application of the intercrossing straps it is therefore not necessary to turn the package, because the desired orthogonal strapping directions are automatically determined by the positioning of the two frame planes at right angles to one another. The whole crosswise strapping process is completed in a singlestage operation. The package is halted only once for the simultaneous application of the two straps. This results in a particularly high working speed. Moreover, the apparatus is made simpler and shorter, and thus less liable to breakdown than known arrangements.

If one of the two strap guide frames is disposed with its frame plane in the transport direction and the other transversely thereto, for the alignment of the package no special guide device will be required to orient the package in the transport direction. In order to ensure that those parts of the strap guide frame disposed in the transport direction which extend upwards from the transport plane will not obstruct the package during its transport, they are temporarily moved to a position in which they permit transport. Examples of such movable constructions of parts of the strap guide frame are already known in the prior art.

The frame planes are however preferably disposed at an angle of 45° to the transport direction. This provides the advantage that no parts of the strap guide frames project as obstructions into the path of transport of the package. For the purpose of adjusting the package to the required 45° position, a special conveyor may be disposed upstream of the apparatus. This has the effect that the package, which is first aligned with the side faces of the cuboid parallel to the direction of transport, will run onto two conveyor belts operating at different speeds and thus be turned 45° before entering the apparatus. The 45° rotation may however also be made in the apparatus itself, for example simply with the aid of stops onto which the package runs, thus being thrown round.

Since the strap guide frames are interlaced crosswise and penetrate into one another, in order to ensure that the two straps will be guided without obstructing one another it is proposed that the strap guide frames should contain strap guide channels which intercross at the point of intersection of the frame planes, and that the inner strap guide channel lying nearer the package should have a break. In the simplest case this break is a stationary gap.

However, if this gap is too wide, the insertion of the strap into the respective strap guide channel may prove difficult. In order to avoid such difficulties, the inner strap guide channel may be constructed to swivel inwards in its frame plane at the break. Another possible arrangement consists in arranging for parts of the inner strap guide channel to be displaceable, at the break, longitudinally in the frame plane between a closed position, in which their two ends situated on either side of the break are in line with one another, and an open position in which a gap is formed between the two ends.

In all cases, the break serves to enable the outer strap to be passed unhindered transversely through the inner strap guide channel while it is being laid around the package. A suitable drive for a movement forming the passage opening is for example a pneumatic cylinder. Since the width of the gap is as a rule small in comparison with the overall dimensions of the strap guide frame, the elasticity of the material of the strap guide frame is in itself sufficient to permit this longitudinal movement, so that no special joints are required on the strap guide frame.

DESCRIPTION OF THE PREFERRED EMBODIMENT

Figure 1:
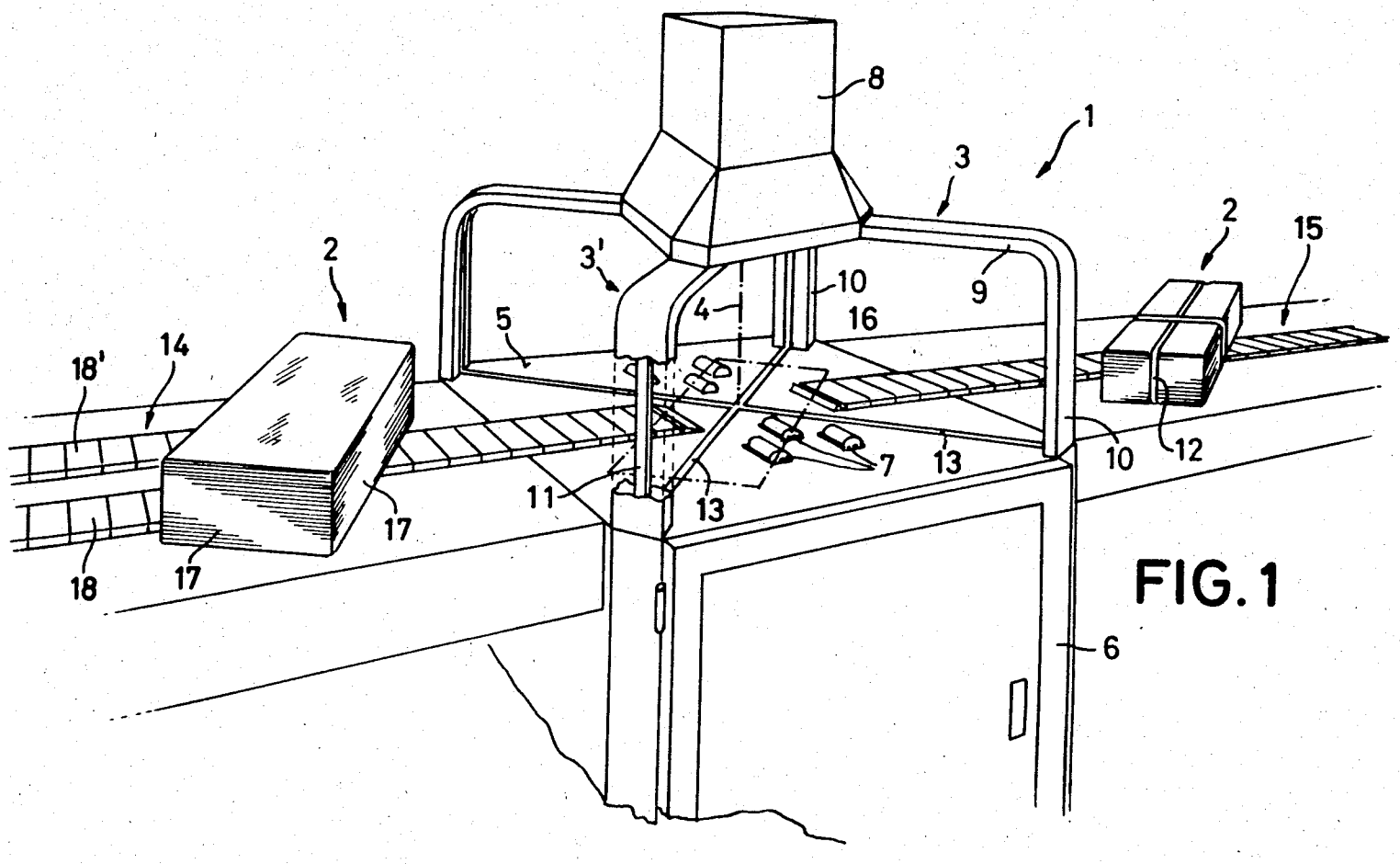
FIG. 1 shows an apparatus for strapping a cuboidal object, in which strap guide frames are disposed at 45° to the direction of transport of the object.

According to FIG. 1, an apparatus 1 for strapping a cuboidal package, namely a stack 2 of newspapers, is provided with strap guide frames 3, 3' extending in respective vertical frame planes. The two frame planes intersect along an imaginary vertical center line 4, by which the clear frame opening formed by the two strap guide frames 3, 3' is divided into two parts of equal size. The horizontal angle enclosed between the two intersecting frame planes amounts to 90°.

In the clear frame opening of the two strap guide frames 3, 3' extends a horizontal transport plane 5, which is formed by the surface of a table 6 carrying the two vertical strap guide frames 3, 3'. In this transport plane are disposed transport rollers 7 which can be driven by a motor. The transport rollers 7 project vertically slightly above the transport plane 5, so that when the stack 2 is laid on the transport rollers 7 it is transported, through their rotation, over the transport plane 5 in a rectilinear transport direction which is at right angles to the axis of the transport rollers 7 and which in the perspective view in FIG. 1 extends from front left to rear right. The frame planes of the two strap guide frames 3,3' are in each case disposed at an angle of 45° to this transport direction.

A press 8 is provided above the strap guide frames 3,3'. This press is equipped with four rams, which in the region of the free corners of the cross formed by the strap guide frames 3 and 3' are adapted to be extended vertically downwards beyond the strap guide frames 3, 3'. These rams act on the top horizontal cuboid face of the stack 2 lying in the position for strapping, compressing it if desired.

More specifically, the two strap guide frames 3, 3', viewed in their frame plane, are constructed substantially in the form of a rectangle having rounded corner regions, the sides 9 and 10 of the rectangle extending horizontally and vertically respectively. The vertical sides 10 of the rectangle pass through the square transport plane 5 at its four corners. The entire clear passage cross-section, at right angles to the direction of transport, of the apparatus 1 is therefore determined in the vertical direction by the vertical length of the rectangle sides, projecting upwards above the transport plane 5, and in the horizontal direction by the horizontal distance between the vertical rectangle sides 10 appertaining to the strap guide frame 3 on the one hand, and to the strap guide frames 3' on the other hand.

Figure 2:
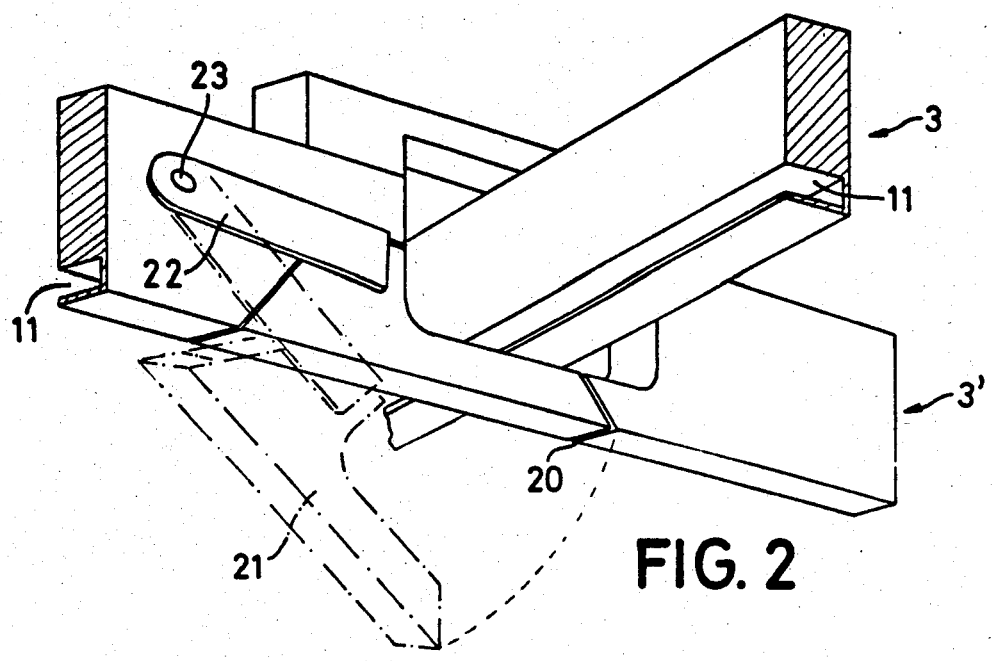
FIG. 2 is a schematic three-dimensional view of a break in the intercrossing region of the two strap guide frames.
Figure 3:
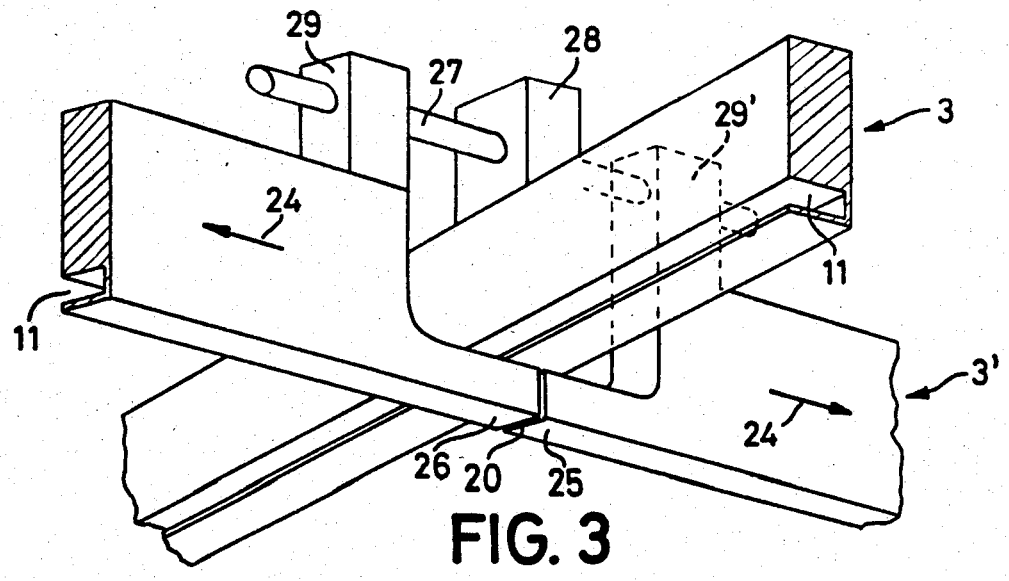
FIG. 3 shows another form of the break.

The strap guide frames 3,3' are each provided on their side pointing inwards, in relation to the clear frame opening, with a strap guide channel 11, which is also shown only schematically in FIGS. 2 and 3. As is known, this strap guide channel 11 is actually constructed in such a manner that when the strap is pulled together it is opened, for example with the aid of hinged parts. As it also known, however, it may also be open at the side, in which case arrangements are made to eject the strap laterally from the channel after a closed loop has been formed but before it is pulled together.

Below the transport plane 5 there is disposed in the table 6 a device by which the straps 12 can be inserted into the strap guide channels 11, described above by way of example, in the two strap guide frames 3, 3'. This device also serves to pull the strap 12 out of the strap guide channel 11 as soon as the stack 2 is in its strapping position on the transport plane 5, and thus to lay it around the stack 2. In addition, the strap 12 is tensioned, locked, and finally cut off by this device. Passage slots 13 disposed along the frame planes allow the strap to pass through the transport plane 5. In order that this device, which contains two so-called locking heads, may be readily accessible for maintenance purposes, the table 6 can be opened by means of a door on its side surface parallel to the transport direction.

Conveyors 14 and 15 are connected to the two sides of the table 6 which extend transversely to the transport direction, the stack 2 being transported by the conveyor 14 in the transport direction onto the transport plane 5, to the strapping position 16 indicated in broken lines. The conveyor 15 on the other hand carries the strapped stack 2 out of the apparatus 1. The stack 2 which is to be strapped must be fed to the apparatus 1 with its vertical cuboid side surfaces 17 at an angle of 45° to the transport direction, in order to enable the strapping to be effected crosswise, parallel to these cuboid side surfaces 17. If, however, the stack 2 which is to be strapped, for example coming from a previous processing stage, is delivered to the apparatus with its cuboid side surfaces 17 parallel or at right angles to the direction of transport, it is then necessary for the object 2 to be turned 45° before it enters the apparatus. For this purpose the conveyor 14 is provided, in a region upstream of the apparatus 1, with two separate conveyor belts 18, 18', which move at different linear speeds such that during its transport over the conveyor belts 18, 18' the stack 2 is turned exactly 45°.

Particular attention must be paid to the point, lying a vertical distance above the center of the transport plane 5, where the two strap guide frames 3 and 3' cross. As is shown in greater detail in FIG. 2, in this crossing region the strap guide channels 11 belonging to the two strap guide frames 3, 3' are disposed one above the other. In order to make it possible for the strap guided in the relatively higher strap guide channel 11 to be laid around the stack 2 despite the strap guide channel 11 lying beneath it, a break 20 serving to form a gap is provided in the lower strap guide channel 11 of the strap guide frame 3'.

In the embodiment shown in FIG. 2 the region of the relatively lower strap guide frame 3' which lies below the upper strap guide frame 3 is constructed to swivel downwards in its frame plane. More specifically, the portion 21 of the relatively lower strap guide channel 11 is fastened to at least one rocking lever 22, which is articulated on the bottom strap guide frame 3' for swivelling about a pivot pin 23 at right angles to the frame plane. The rocking lever 22 is loaded by a spring (not shown) in the direction of the closed position of the portion 21. If therefore the strap, which is not shown in the Figure, is pulled out of the relatively higher strap guide channel 11, which in accordance with the control system occurs only when no strap is present in the relatively lower strap guide channel 11, this upper strap will press the portion 21 against the action of its spring load into the open position shown in broken lines in FIG. 2, and will thus pass across the lower strap guide channel 11. Thus the upper strap can also be laid unhindered around the stack 2. The portion 21 is returned to the closed position by the spring load.

Finally, in the embodiment shown in FIG. 3, the relatively lower strap guide frame 3' is adapted to be pulled out in the longitudinal direction of the strap guide channel 11, as shown by the arrows 24. In the closed position the ends 25, 26 of the relatively lower strap guide channel 11, which are situated on either side of the break 20, lie flush against one another, while after they have been pulled apart in the direction of the arrows 24 a gap is formed. As a slide guide for the two parts of the lower strap guide frame 3', a guide bar 27 is fastened on a vertical extension 28 of the upper strap guide frame 3 and is slidably mounted in guide pins of extensions 29, 29'.

What we claim is:

1. An apparatus for receiving a cuboidal package from a longitudinal conveyor that transports the package along a path and for strapping the package, as it rests on a horizontal delivery plane that is disposed along the path, by means of two intercrossing straps encircling the package in cross-sectional planes at right angles to one another, comprising two strap guide frames, each having a clear frame opening, which in respect of their frame planes are disposed at right angles to the horizontal delivery plane with the path extending through their clear frame opening, the strap being adapted to be guided, in each of the said guide frames, around the clear frame opening, and further comprising, associated with each strap guide frame, a device for inserting the strap into the strap guide frame and also for tensioning, locking, and cutting off the strap laid around the package, wherein the frame planes of the two strap guide frames (3, 3') intersect at right angles along a common vertical center line (4), while a device (18, 18') is provided for adjusting the package (2) to a position in which its edges are parallel to the strap guide frames.

2. An apparatus as claimed in claim 1, wherein the path has a straight portion adjacent the delivery plane and wherein the frame planes (3, 3') are disposed at an angle of 45° to the straight portion.

3. An apparatus as claimed in claim 1, wherein the strap guide frames (3, 3') contain strap guide channels (11) which intercross at the point of intersection of the frame planes, while the inner strap guide channel lying nearer the package has a break (20).

4. An apparatus as claimed in claim 2, wherein at the break (20) the inner strap guide channel is adapted to swivel inwards (21) in its frame plane.

5. An apparatus as claimed in claim 2, wherein at the break (20) parts of the inner strap guide channel are longitudinally displaceable in the frame plane between a closed position, in which their two ends (25,26) situated on either side of the break are in line with one another, and an open position in which a gap is formed between the two ends.

* * * * *